United States Patent [19]

Cole

[11] Patent Number: 4,608,556

[45] Date of Patent: Aug. 26, 1986

[54] SMOKE DETECTION APPARATUS

[76] Inventor: Martin T. Cole, 29 Stafford Street, Huntingdale, Victoria, Australia

[21] Appl. No.: 626,706

[22] Filed: Jul. 2, 1984

[30] Foreign Application Priority Data

Jul. 4, 1983 [AU] Australia ..... PG0116

[51] Int. Cl.[4] ..... G08B 19/00

[52] U.S. Cl. ..... 340/628; 340/522; 340/590; 340/630; 116/106; 137/74; 73/863.01

[58] Field of Search ..... 73/863.01, 864.73; 340/628, 629, 630, 587, 588, 590, 594, 691, 693, 521, 522, 523; 116/214, 217, 218, 219, 221, 216, 101, 106, 5, 220, DIG. 38; 137/74, 79, 468, 551; 138/89

[56] References Cited

U.S. PATENT DOCUMENTS

| | | | |
|---|---|---|---|
| 1,168,506 | 1/1916 | Jenne | 340/591 |
| 1,386,370 | 8/1921 | Schwimmer | 137/74 X |
| 1,755,834 | 4/1930 | Morr et al. | 340/628 X |
| 1,921,809 | 8/1933 | Crain | 138/89 |
| 1,979,875 | 11/1934 | Faus | 116/214 X |
| 2,143,982 | 1/1939 | Hare et al. | 138/89 X |
| 2,427,088 | 9/1947 | Chapman et al. | 116/5 |
| 2,660,052 | 11/1953 | Uhl | 340/628 X |
| 2,696,798 | 12/1954 | Jacoby | 116/106 |
| 3,420,575 | 1/1969 | Hübner | 73/864.73 X |
| 3,678,487 | 7/1972 | Ludewig, Jr. | 340/628 X |
| 3,927,791 | 12/1975 | Hershberger | 138/89 X |
| 3,938,115 | 2/1976 | Jacoby | 340/628 X |
| 4,254,414 | 3/1981 | Street et al. | 340/628 X |
| 4,317,453 | 3/1982 | Hein et al. | 73/863.01 X |
| 4,441,356 | 4/1984 | Bohl | 137/468 X |
| 4,502,341 | 3/1985 | Hall, II | 73/863.01 |

FOREIGN PATENT DOCUMENTS

| | | | |
|---|---|---|---|
| 590417 | 1/1960 | Canada | 340/590 |
| 3237021 | 5/1981 | Fed. Rep. of Germany | 340/521 |
| 1393584 | 12/1965 | France | 138/89 |
| 2500569 | 8/1982 | France | 137/79 |
| 12662 | 8/1966 | Japan | 340/628 |
| 46348 | 4/1981 | Japan | 340/590 |
| 778318 | 7/1957 | United Kingdom | 116/101 |
| 782559 | 9/1957 | United Kingdom | 137/74 |
| 1564796 | 4/1980 | United Kingdom | 340/590 |

*Primary Examiner*—Stewart J. Levy
*Assistant Examiner*—Tom Noland
*Attorney, Agent, or Firm*—Learman & McCulloch

[57] ABSTRACT

A heat sensitive air/gas sampling device including an apertured housing for connection to a pipe leading to a smoke detector device the housing including a blocking device for preventing air/gas to enter the housing, the blocking device being ineffective to prevent ingress of air/gas when the surrounding temperature exceeds a predetermined maximum for a predetermined period of time. The blocking device may be held by, or composed of, a low melting point wax. The blocking device may be comprised of a bimetallic strip.

5 Claims, 12 Drawing Figures

140 sec 170 sec 216 sec 218 sec 217 sec 15 sec

SMOKE DETECTION APPARATUS

This invention relates to smoke detection apparatus.

Most modern furnishing materials can produce extremely dangerous fumes when burned including Carbon Monoxide, Hydrogen Cyanide and Hydrogen Chloride. Because of the highly toxic nature of these materials when burnt, time has become the crucial factor in preserving life and possessions against fire, almost everywhere indoors.

Economical, extremely sensitive, early-warning smoke detection devices have been developed to meet this modern day threat. The most effective detection device known to the inventor employs an optical principle, whereby the light scattered off particles of smoke within a sampling chamber, is detected to produce an output proportional to smoke intensity. In this way, sensitivity to all forms of smoke, as rare as 0.01% per meter obscuration, (i.e. 20 micrograms/cubic meter equivalent to a visual range of 40 kilometers) is made possible. The fundamental requirement is to transport a sample of the smoke-laden air to said sampling chamber, by means of a smoke transport system. A sampling chamber is disclosed in my co-pending Australian application No. PG 0820/83 filed Aug. 12, 1983.

Said smoke transport system may take the form of a pipe or network thereof, configured to draw a continuous small sample of air from the areas within which fire detection is required. The aggregate of all said areas constitutes one fire zone. Said continuous sample of air from said zone is drawn by means of a fan, downstream from said sampling chamber. Each location where an opening is made to allow the passage of air into said smoke transport system, constitutes a sampling point.

Under normal, non-fire conditions, the atmosphere may be relatively clear of smoke depending upon the use of the premises. Dormitories in a school, or partitioned office blocks for example, would have a relatively clear atmosphere. However, the kitchen in each House Master's quarters of that school could have a smokey atmosphere at cooking times, while bathrooms would regularly become steamed. Furthermore, certain areas of a factory such as a main workshop may have a polluted atmosphere whereas other areas in the factory are relatively clear. Thus in one building, there could be a mixture of clear and laden atmospheres. The use of sensitive smoke detection apparatus in said areas would certainly lead to false alarms.

One solution could be to alternate the use of thermal and smoke detection devices appropriately throughout the zone. In practice this would complicate an installation, requiring two types of control panel and the individual wiring of thermal detectors and the running of pipework for smoke detection. These complications would increase the overall cost significantly.

The most effective, economical and versatile solution is embodied in the present invention by providing an improved smoke detection system which is independent of normal or ambient foggy and smokey conditions not associated with a dangerous rise in temperature.

There is provided according to the present invention in a smoke detection system including an air sampling pipe and an associated smoke detection device the improvement comprising, an apertured housing adapted for connection to said pipe, a plug means in said housing controlling flow of ambient air to said air sampling pipe such that under normal ambient conditions ambient air is blocked from said air sampling pipe, said plug means consisting of, or being retained by, a low melting point substance such that when the ambient air temperature exceeds said melting temperature said air is admitted to said sampling pipe for exposure to said detection device.

In one aspect of the invention there is provided a heat activated sampling device for gaseous fluids including an apertured housing adapted to connect to a sampling pipe for transporting gas, heat sensitive means for controlling flow of gas through the apertured housing, said means being ineffective to control the flow of gas when the surrounding gas temperature exceeds a predetermined minimum.

There is also provided in a smoke detection system requiring a gas sampling pipe; a device comprising a heat collecting blocking means retained in a housing by a stable temperature responsive substance adapted to block the flow of gas into said gas sampling pipe, said blocking means being ineffective to block the flow of gas when the surrounding gas temperature exceeds a predetermined maximum.

Conveniently, the present invention utilises a housing, a suitable wax or low melting point metal such as "Woods metal" and a heat-collector plug. Said wax or metal acting as an adhesive to retain said plug in such a manner that said sampling point is normally blocked. Said plug is configured, and is of suitable composition, to act as an efficient collector of heat from the surrounding atmosphere. Upon said plug collecting and conducting sufficient heat to melt said wax or metal adhesive, said plug falls away from said housing, to expose said aperture. Using wax or metal of melting point 67 degrees Celsius, results in exposure of said sampling point in fifteen seconds to four minutes, depending upon the design of the heat activated sampling point (H.A.S.P.) components.

The variation in delay times result from variations in design parameters such as surface area of the plug, its mass conductivity and various other factors. However, factors such as ruggedness and appearance in use may be adversely affected in achieving extremely short reaction times. The present invention is seen as an effective compromise taking into account these parameters. Considerations of cost and aesthetics may dominate the design choice.

In practice said fire zone may utilize the heat activated sampling point (H.A.S.P.) technique in every area, whilst a building may contain several said zones. The H.A.S.P. technique would be appropriate in highly dusty areas, such as a joinery factory. Waxes of various melting points could be chosen in accordance with the maximum ambient temperatures prevailing. Thus, application in relatively hot and smokey environments such as boiler rooms or standby generator rooms would be possible.

PREFERRED EMBODIMENT

Figure 1:
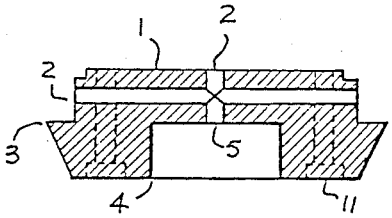
FIG. 1 is a sectional view of a sampling point mounting base.
Figure 2:
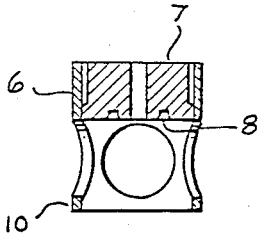
FIG. 2 is a sectional view of a sampling point cartridge assembly.

In a preferred embodiment of this invention, a convenient circular mounting base (1) is provided. Said base is adapted to be mounted to the ceiling in various possible ways to suit circumstances. Accordingly said base is sized to match a standard circular electrical junction box of a type which may be surface-mounted or may have been pre-cast into a concrete floor slab. Said base is also configured for direct surface-mounting.

Push-fit airtight coupling to the pipe network is facilitated by tapered holes (2) into said base, permitting top entry, side entry, or tee-junctioning. Obviously while sampling, unused ones of the tapered holes 2 are plugged or otherwise blockingly sealed by other equally well known means. An annular rim (3) is provided for aesthetic appeal and where appropriate, to provide a ledge to hide the end of a run of surface-mounted rectangular conduit. The underneath of said base has a deep, tapered cylindrical recess (4), in the center of which is the actual orifice (5) of said sampling point.

A cylindrical cartridge assembly (6) consisting of said housing (7) with an integral well to contain said wax adhesive (8) and said heat-collecting plug (9), is adapted to be held by wax adhesion in said recess, to block said sampling point. Included with said housing is a ventilated protective guard means (10) to prevent damage from thrown objects, which might otherwise cause the seal of said wax to be broken and said heat collecting plug to fall away. Said mounting base is provided with counter bored holes (11) positioned at right-angles to the cross-section shown, to facilitate attachment to the ceiling or junction box by means of two screws.

The heat collecting plug should be of high heat conducting material such as copper, aluminium or ceramic.

Figure 5:
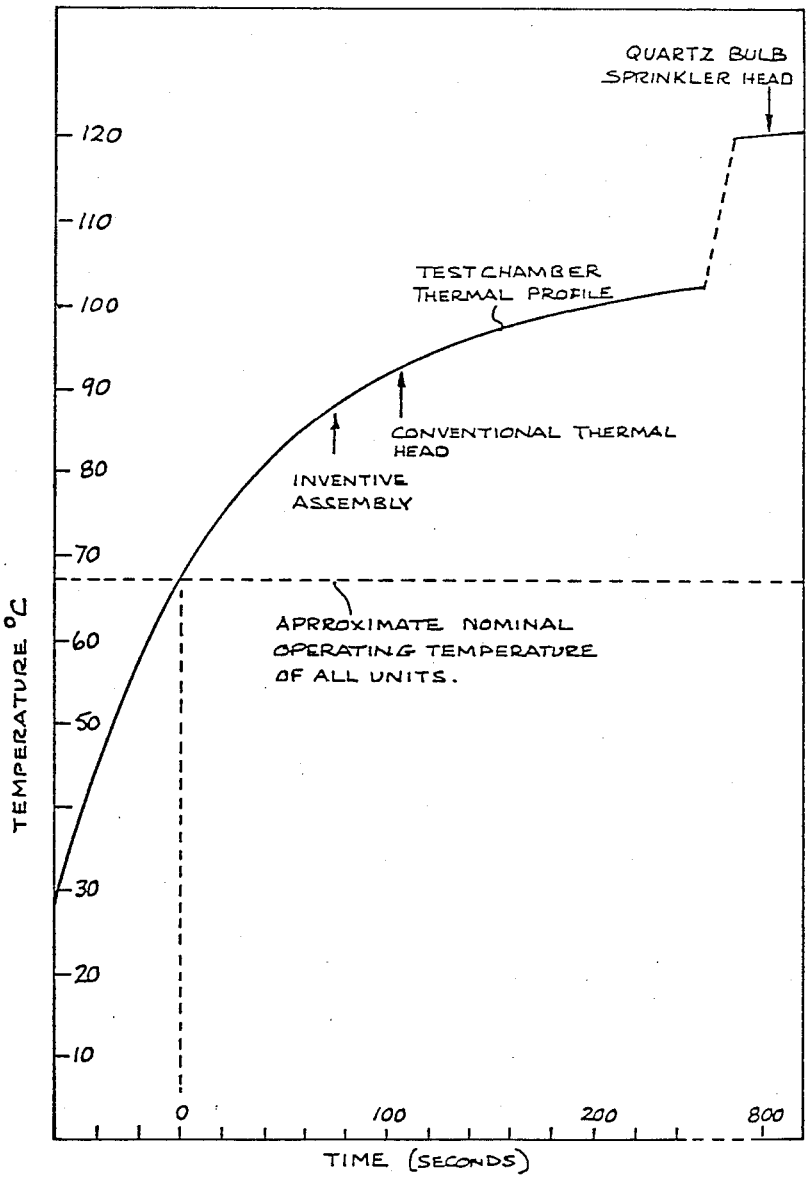
FIG. 5 is a graphical representation of comparative thermal performance of conventional heat detectors and the sampling point assembly of the present invention.
Figure 6A:
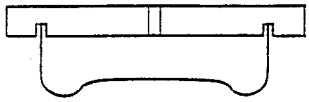
FIGS. 6*a*, 6*b*, 6*c*, 6*d*, 6*e*, 6*f* are schematic representations of but a few examples of heat collectors.
Figure 6B:
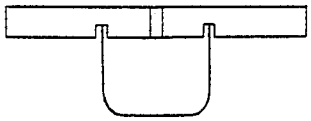
Figure 6C:
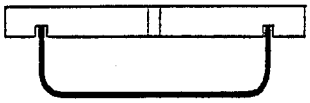
Figure 6D:
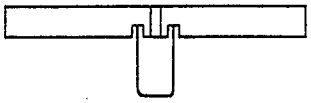
Figure 6E:
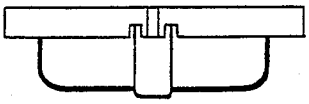
Figure 6F:
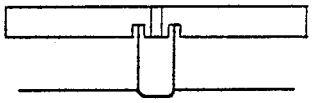

With reference to FIG. 5 the curve indicates a thermal profile of temperature against time in a test chamber housing various test heads. As can be seen a conventional quartz bulb sprinkler head has a delay time of approximately 13 minutes whereas a conventional thermal detector is in excess of 100 seconds. The sampling point assembly of the present invention is a little less than 80 seconds in the arrangement shown.

Considerable advantage is gained by the use of a removable cartridge assembly 6 which may be a press fit or threaded. The fire brigade may conduct testing of every sampling point at any time, simply by removing said cartridge and introducing test smoke. Moreover, should conditions within the zone change or should initial predictions of air clarity prove incorrect, said bases may have said cartridges inserted or removed at will. For uniformity in appearance said cartridges are made available with and without said heat-collecting plug installed, such that a cartridge of either type is inserted into every said base.

Referring to FIGS. 6(*a*), 6(*b*), 6(*c*), 6(*d*), 6(*e*) 6(*f*) these show schematically various examples of heat collecting plug or blocking means 9 housed in a recess 8 to shroud and block aperture 5.

The blocking member 9 is secured into the well by a wax adhesive for example TECHNIWAX 9210 which is an adhesive consisting of a long chain hydrocarbon wax having a melting point in the range of 64° to 68° C.

As mentioned previously various design parameters influence the delay time before the wax seal is melted and the blocking member 9 falls away to expose the aperture 5. Thus, the material may be thin and have a large surface area such as in FIGS. 6(*a*) and 6(*f*) resulting in relatively short delay times after 67° C. is exceeded under test. Alternatively blocking members of thin material and relatively small surface area such as FIGS. 6(*b*) and 6(*d*) take longer to break the seal. Blocking members having greater mass and relatively high surface area such as FIGS. 6(*c*) and 6(*e*) also exhibited long delay times before breaking away from the wax seal. The latent heat of the wax, its mass and the surface area and geometry of the plug all become factors affecting the reaction time of the unit. The delay resulting from said reaction time may be of benefit in avoiding false alarms caused by transient but safe rises in temperature. The delay time for each example in FIGS. 6(*a*) to 6(*f*) is shown on each Figure.

Figure 3:
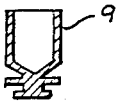
FIG. 3 is a sectional view heat collecting plug.
Figure 4:
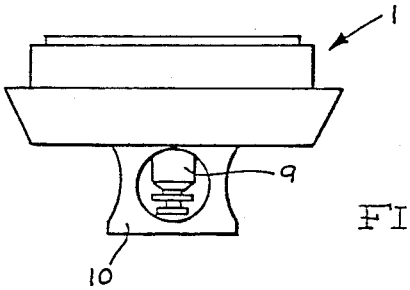
FIG. 4 is an elevational view of a sampling point assembly.

The example depicted in FIGS. 3 and 4 of a finned heat collecting blocking member 9 surrounded by a guard provides a good balance of robustness yet exhibits a low delay time of approximately 78 seconds.

Figure 7:
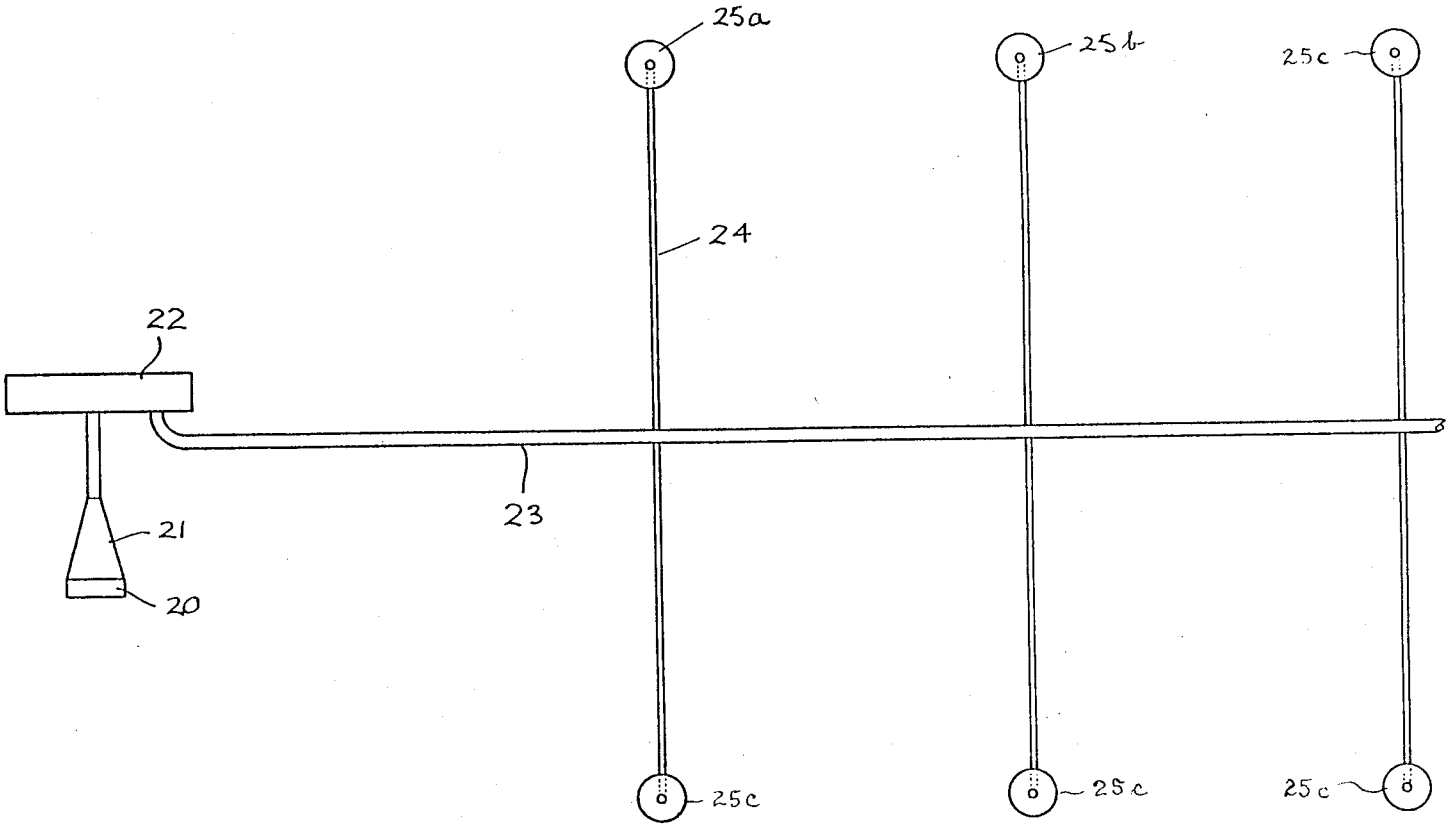
FIG. 7 is a schematic view of smoke detection system.

With reference to FIG. 7 there is shown schematically a reticulation smoke transport system of sampling pipes 23 and 24 leading to various sampling areas to detect the presence of smoke in those areas.

The transport system leads back to a sampling chamber or tube 22 of the type described in my co-pending Australian Patent Application No. PG0820/83 filed Aug. 12, 1983 entitled "Smoke Detection Apparatus".

At the various sampling areas the terminal ends of the branch sampling pipes are connected to individual sampling heads 25*a*, 25*b* and 25*c*.

For illustration purposes one of the six branch sampling pipes shown in this embodiment is labelled "24". The sampling heads are adapted to contain fusible plugs of the type disclosed herein to allow thermally responsive smoke detection by the common detector 22 from a plurality of areas. This is achieved because each individual sampling head is independently and fluidly connected by an individual branch sampling pipe to the main sample collecting pipe 23 which in turn leads to the common smoke detection chamber 22.

Gas is continually drawn from the system by a fan 20 drawing through a diffuser 21 to enhance the performance of the said fan. In an alternative embodiment of the invention the blocking means may include a temperature responsive bimetallic strip (not shown) blocking the opening to the air sampling pipe. The strip may be of various dissimilar metals, such as copper and steel, rivetted or welded together and arranged to distort upon the surrounding temperature level exceeding a predetermined level which is usually indicative of fire.

I claim:

1. In a smoke detector system including a sampling pipe which is connected to an associated smoke detection device, the improvement comprising:

an aperatured housing adapted for connection to said pipe at a point on said pipe remote from the connection of said pipe to said associated smoke detection device;

plug means in said housing for controlling flow of ambient gaseous atmosphere to said sampling pipe such that under normal ambient conditions ambient gaseous atmosphere is blocked from said sampling pipe;

said plug means comprising a low melting point substance such that when the ambient temperature exceeds the melting temperature of said substance, said plug means becomes ineffective to block the flow of ambient gaseous atmosphere, and ambient gaseous atmosphere is admitted to said sampling pipe for exposure to said associated smoke detection device.

2. The subject matter of claim 1 in which said apertured housing comprises a base (1) adapted for fastening to a support;

orifice means (5) in the exposed face of said base for admission of said ambient gaseous atmosphere;

a cylindrical cartridge assembly (6), readily and detachably mounted on said exposed face to be in pneumatic communication with said orifice means;

said cylindrical cartridge assembly comprising said plug means and said low melting point substance.

3. The subject matter of claim 1 in which said apertured housing comprises a base (1) adapted for fastening to a support;

orifice means (5) in the exposed face of said base for admission of said ambient gaseous atmosphere;

a ventilated protective guard means (10), mounted on said exposed face to surround said plug means and said orifice means, for protecting said plug means and said orifice means from thrown objects.

4. The subject matter of claim 1 in which said apertured housing comprises a base (1) adapted for fastening to a support;

orifice means (5) in the exposed face of said base for admission of said ambient gaseous atmosphere;

said orifice ending, in said apertured housing, in a branching pipe junction;

each of the branches (2) of said branching pipe junction having a circular cross section ending at the surface of said housing and each of said branches having a taper to facilitate connection of a circular sampling pipe thereto in an air-tight coupling by pushfitting.

5. In a smoke detector system, a smoke detection means comprising a sampling chamber (22) for automatically sensing the presence of smoke in said sampling chamber;

a reticulation smoke transport system for continuously sucking ambient air samples from a plurality of spaced sampling locations, for combining said samples and for delivering said combined samples to said smoke detection means;

said reticulation smoke transport system comprising an exhaust fan (20) for continuously sucking said combined samples out of said smoke detection means;

said reticulation smoke transport system further comprising a main sampling pipe (23) connected to said sampling chamber for delivering said combined samples thereto;

a plurality of branch sampling pipes, each connected at one end to said main sampling pipe, having the other end terminated at a respective one of said plurality of spaced sampling locations, and connected to a respective one of a plurality of sampling heads at said respective one of said plurality of spaced sampling locations;

whereby said exhaust fan sucks individual air samples from said plurality of sampling locations, through the respectives ones of said branch sampling pipes, through the main sampling pipe, and out through said smoke detection device;

at least one of said sampling heads comprising means to individually and selectively block the admission of air samples from the respective sampling location thereof to the respective branch sampling pipe thereof when the temperature thereat is below a value of temperature high enough to indicate a danger condition at the background thereof but which will not block the admission of air and any smoke entrained therein when the temperature thereat is above said value except for possibly a small transient time when the value is initially exceeded.

* * * * *